US005409504A

United States Patent [19]

Fritzsche

[11] Patent Number: 5,409,504

[45] **Date of Patent: * Apr. 25, 1995**

[54] PROCESS FOR FIXING DYES WITH UV LIGHT

[75] Inventor: Katharina Fritzsche, Weil am Rhein, Germany

[73] Assignee: Ciba-Geigy Corporation, Ardsley, N.Y.

[ * ] Notice: The portion of the term of this patent subsequent to Aug. 24, 2010 has been disclaimed.

[21] Appl. No.: 941,597

[22] Filed: Sep. 8, 1992

[30] Foreign Application Priority Data

Sep. 13, 1991 [CH] Switzerland ..... 2724/91

[51] Int. Cl.[6] ..... D06P 5/20; C09B 69/10

[52] U.S. Cl. ..... 8/444; 8/552; 8/555; 8/647; 8/662; 8/115.53; 8/DIG. 2

[58] Field of Search ..... 8/444, 115.53, 555, 8/549, 558, 552, 675, 662, DIG. 2, 647

[56] References Cited

U.S. PATENT DOCUMENTS 2,897,101 7/1959 Graulich et al. ..... 117/139.5
4,588,411 5/1986 Scheibli et al. ..... 8/528
5,238,465 8/1993 Fritzsche ..... 8/444

FOREIGN PATENT DOCUMENTS 1316458 5/1973 United Kingdom .
1341199 12/1973 United Kingdom .
1596827 9/1981 United Kingdom .

OTHER PUBLICATIONS

Textile Chem. & Col. vol. 10 pp. 220–224 Oct. 1978.
Textile Chem. & Col. vol. 11 pp. 107–113 May, 1979.
Metropolitan Section, vol. 2 No. 24 pp. 414–424 Dec. 2, 1970.
Chem. Abst. 112:199,89/a (EP337,951) Oct. 18, 1989.
Chem. Abst. 88:10696/w (DE 2,632,010) Jan. 19, 1978.
Journal of Polymer Science, vol. 29, No. 9 pp. 1319–1327 Dec. 28, 1990.
Chem Abst 84:166157r Jun. 21, 1975.

*Primary Examiner*—Paul Lieberman
*Assistant Examiner*—Caroline L. Dusheck
*Attorney, Agent, or Firm*—George R. Dohmann; Marla J. Mathias

[57] ABSTRACT

The invention provides a process for fixing dyes on organic material, which comprises fixing dyes containing at least one polymerizable double bond or at least one polymerizable ring system, in the presence of at least one colorless binder which contains at least one polymerizable double bond, and at least one photosensitizer, as well as further optional auxiliaries, by subjecting said material to irradiation with UV light. The invention also provides a dyeing formulation which enables the dyeing to be fixed by the inventive process.

16 Claims, No Drawings

PROCESS FOR FIXING DYES WITH UV LIGHT

The present invention relates to a process for fixing dyes which contain polymerisable double bonds on organic materials by irradiation with UV light in the presence of a colourless polymerisable binder and a photosensitiser.

Specifically, the invention relates to a process for fixing dyes on organic material, which comprises fixing dyes containing at least one polymerisable double bond or at least one polymerisable ring system, in the presence of at least one colourless binder which contains at least one polymerisable double bond, and at least one photosensitiser, as well as further optional auxiliaries, by subjecting said material to irradiation with UV light.

Suitable dyes are water-soluble and water-insoluble dyes which are characterised in that they contain polymerisable double bonds. These polymerisable groups can also be linked to the chromophore through a spacer, for example a $—(CH_2—CH_2—O)_n$ group.

Water-soluble dyes will be understood as meaning in particular dyes which contain chromophores carrying sulfo groups. Suitable water-insoluble dyes are disperse dyes which contain a polymerisable group and are soluble in the photopolymerisable binder.

Suitable polymerisable double bonds are vinyl, vinyl chloride, vinyl sulfone, allyl, allyl sulfone, acrylate, methacrylate, acrylamide, methacrylamide, haloacrylamide, styryl groups and derivatives of cinnamic acid.

Dyes which may suitably be used for the novel fixation process are those which contain an activated unsaturated group, preferably an unsaturated aliphatic group, typically the vinyl, halovinyl, styryl, acryloyl or methacryloyl group. Exemplary of such groups are the halogen-containing unsaturated groups such as the halomaleic acid and halopropiolic acid groups, the $\beta$- or $\beta$-bromo- or chloroacryloyl groups, halogenated vinylacetyl groups, halocrotonyl or halomethacryloyl groups. Also suitable are those groups which are readily converted to halogenated unsaturated groups, typically the dichloropropionyl or dibromopropionyl group. Halogen atoms will be taken to mean in this context fluorine, chlorine, bromine and iodine atoms as well as pseudo-halogen atoms, conveniently the cyano group. Good results are obtained by the inventive process with dyes which contain an $\alpha$-bromoacrylolyl group. Dyes which contain a polymerisable double bond are suitably those which contain at least one acryloyl, $\alpha$-bromoacryloyl, $\alpha$-chloroacryloyl or vinylsulfonyl radical. Dyes which contain a polymerisable ring system are preferably those which contain at least one epoxide radical.

The chromophoric systems used may belong to the most diverse classes of dye.

A preferred embodiment of the novel process comprises the use of dyes of formula $$D—(X)_m \quad (1),$$

wherein D is the radical of an organic dye of the monoazo or polyazo series, of the metal complex azo, anthraquinone, phthalocyanine, formazan, azomethine, nitroaryl, dioxazine, phenazine, stilbene, triphenylmethane, xanthene, thioxanthone, naphthoquinone, pyrenequinone or perylenetetracarbimide series, X is a polymerisable double bond or a polymerisable ring system, and m is 1,2,3,4,5 or 6.

A particularly preferred embodiment of the novel process comprises the use of water-soluble dyes of formula (1), wherein a) D is the radical of a formazan dye of formula

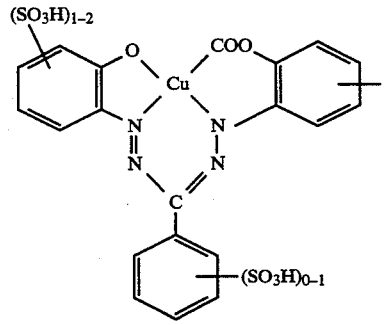

(2a)

or

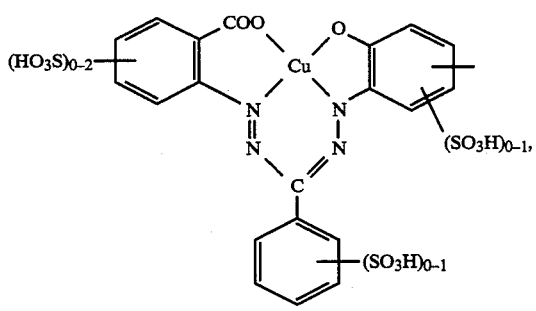

(2b)

wherein the benzene nuclei may be substituted by alkyl of 1 to 4 carbon atoms, alkoxy of 1 to 4 carbon atoms, alkylsulfonyl of 1 to 4 carbon atoms, halogen or carboxy, b) D is the radical of an anthraquinone dye of formula

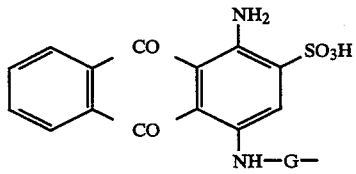

(3)

wherein G is a phenylene, cyclohexylene or $C_2$–$C_6$alkylene radical, the anthraquinone nucleus of which dye may be substituted by a further sulfo group and G as phenyl radical may be substituted by alkyl of 1 to 4 carbon atoms, alkoxy of 1 to 4 carbon atoms, halogen, carboxy or sulfo.

c) D is the radical of a phthalocyanine dye of formula

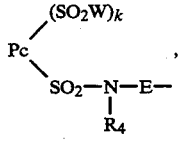

(4)

wherein Pc is the radical of a copper or nickel phthalocyanine; W is —OH and/or $—NR_5R_6$; $R_5$ and $R_6$ are each independently of the other hydrogen or alkyl of 1 to 4 carbon atoms which may be substituted by hydroxy or sulfo; $R_4$ is hydrogen or alkyl of 1 to 4 carbon atoms, E is a phenylene radical which may be substituted by alkyl of 1 to 4 carbon atoms, halogen, carboxy or sulfo; or is an alkylene radical of 2 to 6 carbon atoms, preferably a sulfophenylene or ethylene radical; and k=1,2 or 3.

d) D is the radical of a dioxazine dye of formula

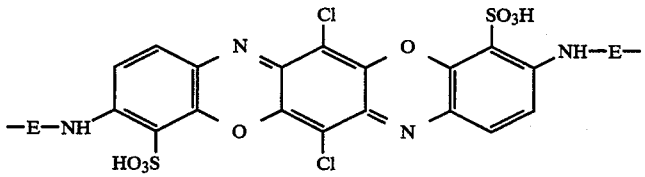

(5a)

or

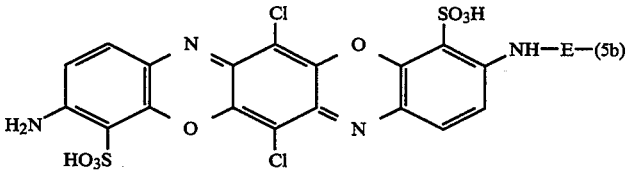

(5b)

wherein E is a phenylene radical which may be substituted by alkyl of 1 to 4 carbon atoms, halogen, carboxy or sulfo; or is an alkylene radical of 2 to 6 carbon atoms; and the outer benzene rings in formulae (5a) and (5b) can be further substituted by alkyl of 1 to 4 carbon atoms, alkoxy of 1 to 4 carbon atoms, acetylamino, nitro, halogen, carboxy or sulfo.

It is also particularly preferred to use dyes of formula (1 ), wherein D is the radical of an azo dye, preferably a radical of formulae 6 to 17:

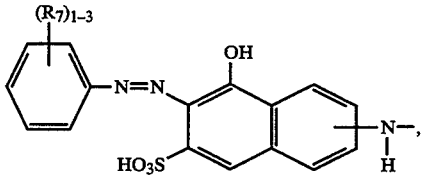

(6)

wherein $(R_7)_{1-3}$ denotes 1 to 3 substituents selected from the group consisting of $C_{1-4}$alkyl, $C_{1-4}$alkoxy, halogen, carboxy and sulfo;

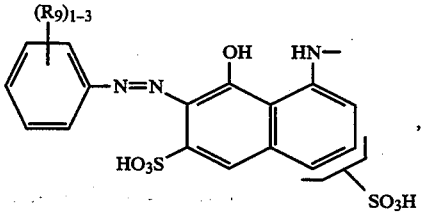

(7)

wherein $(R_9)_{1-3}$ denotes 1 to 3 substituents selected from the group consisting of $C_{1-4}$alkyl, $C_{1-4}$alkoxy, halogen, carboxy and sulfo;

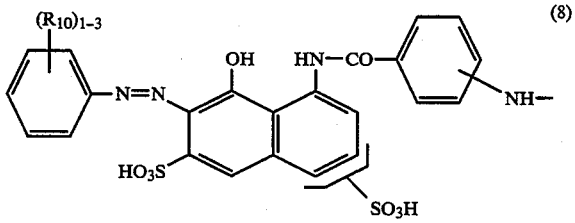

(8)

wherein $(R_{10})_{1-3}$ denotes 1 to 3 substituents selected from the group consisting of $C_{1-4}$alkyl, $C_{1-4}$alkoxy, halogen, carboxy and sulfo;

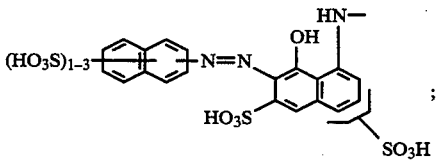

(9)

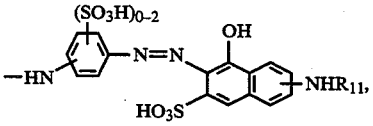

(10)

wherein $R_{11}$ is $C_{2-4}$alkanoyl or benzoyl;

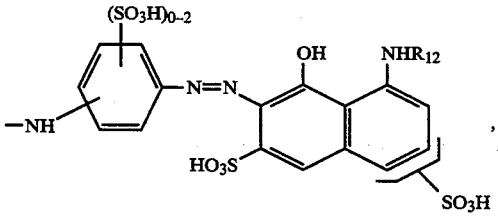

(11)

wherein $R_{12}$ is $C_{2-4}$alkanoyl or benzoyl;

(12)

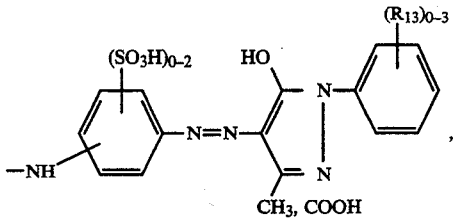

wherein $(R_{13})_{0-3}$ denotes 0 to 3 substituents selected from the group consisting of $C_{1-4}$alkyl, $C_{1-4}$alkoxy, halogen, carboxy and sulfo;

(13)

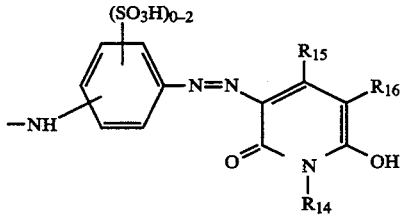

wherein $R_{14}$ and $R_{15}$ are each independently of the other hydrogen, $C_{1-4}$alkyl or phenyl, and $R_{16}$ is hydrogen, cyano, carbamoyl or sulfomethyl;

(14)

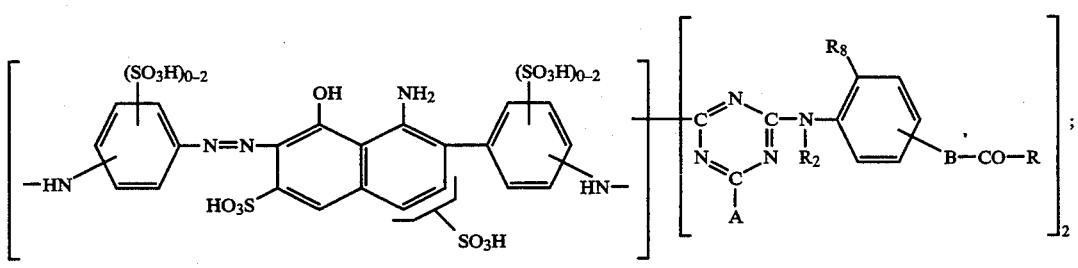

(15)

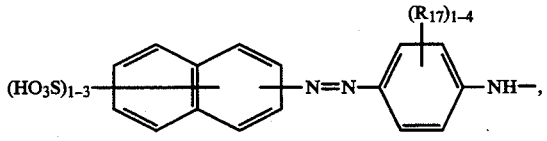

wherein $(R_{17})_{1-4}$ denotes 1 to 4 substituents selected from the group consisting of hydrogen, halogen, nitro, cyano, trifluoromethyl, sulfamoyl, carbamoyl, $C_{1-4}$alkyl, $C_{1-4}$alkoxy, amino, acetylamino, ureido, hydroxy, carboxy, sulfomethyl and sulfo, independently of one another;

(16)

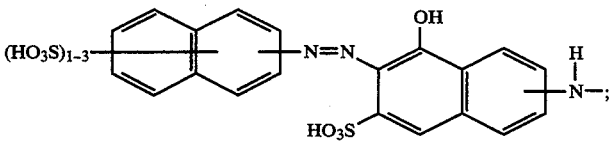

(17)

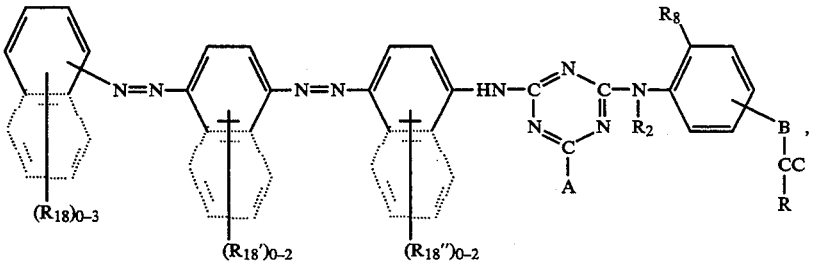

wherein $(R_{18})_{0-3}$,$(R_{18'})_{0-2}$ and $(R_{18''})_{0-2}$ are each independently of one another 0 to 3 or 0 to 2 substituents selected from the group consisting of $C_{1-4}$alkyl, $C_{1-4}$alkoxy and sulfo.

A further preferred embodiment of the novel process comprises the use of water-insoluble or substantially water-insoluble azo dyes of formula (20)

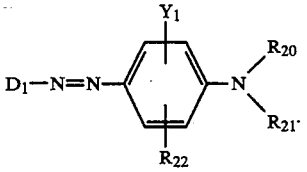

wherein $D_1$ is the radical of a carbocyclic or heterocyclic diazo component which is devoid of water-solubilising substituents;

$Y_1$ is chloro, methyl, methoxy, methoxyethyl, methoxyethoxy or hydrogen;

$R_{20}$ and $R_{21}$ are each independently of the other $C_1$–$C_6$alkyl, $C_3$–$C_6$alkenyl, phenyl or the radical $—B_1—X_1$;

$R_{22}$ is hydrogen, methyl, methoxy, chloro, bromo or the radical $X_1$;

$X_1$ is a radical containing a polymerisable double bond;

$B_1$ is an unsubstituted or substituted radical of formula $-(CH_2)_m-(C_6H_4)_n-(CH_2)_o-$;
wherein m is an integer from 1 to 6
n is 0 or 1 and
o is an integer from 0 to 6;

and at least one of $R_{20}$, $R_{21}$ or $R_{22}$ has the meaning of $X_1$ or is substituted by a radical $X_1$.

$D_1$ is preferably the radical of a homocyclic or heterocyclic diazo component, conveniently selected from the series consisting of thienyl, phenylazothienyl, thiazolyl, isothiazolyl, 1,2,4-thiadiazolyl, 1,3,4-thiadiazolyl, benzothiazolyl, benzisothiazolyl, pyrazolyl, 1,2,3-triazolyl, 1,2,4-triazolyl, imidazolyl, and phenyl. Each of these systems can carry further substituents such as alkyl, alkoxy or alkylthio, each of 1 to 4 carbon atoms, phenyl, electronegative groups such as halogen, preferably chloro or bromo, trifluoromethyl, cyano, nitro, acyl, typically acetyl or benzoyl, carboalkoxy, preferably carbomethoxy or carboethoxy, alkylsulfonyl of 1 to 4 carbon atoms, phenylsulfonyl, phenoxysulfonyl, sulfamoyl or arylazo, preferably phenylazo. Two adjacent substituents of each of these ring systems may also together form fused rings, typically phenyl rings or cyclic imides.

Most preferably $D_1$ is a benzothiazolyl, benzisothiazolyl or phenyl radical which is unsubstituted or substituted by one or two of the radicals cited above.

The alkyl radicals may be substituted, conveniently by hydroxy, alkoxy of 1 to 4 carbon atoms, preferably methoxy, cyano or phenyl. Further suitable substituents are halogen, typically fluoro, chloro or bromo, or —CO—U or —O—CO—U, wherein U is alkyl of 1 to 6 carbon atoms or phenyl.

Suitable alkenyl radicals are those which are derived from the above cited alkyl radicals by replacing at least one single bond by a double bond. Suitable alkenyl radicals are typically ethenyl or propenyl.

Phenyl radicals will be understood as meaning unsubstituted or substituted phenyl radicals. Suitable substituents may be $C_1$-$C_4$alkyl, $C_1$-$C_4$alkoxy, bromo, chloro, nitro or $C_1$-$C_4$alkylcarbonylamino.

The radical $X_1$ may suitably be a radical derived from acrylic, methacrylic or cinnamic acid. To be singled out for special mention are the radicals of formula —NH—CO—CH=$CH_2$, —NH—CO—C($CH_3$)=$CH_2$, —NH—CO—CBr=$CH_2$,—NH—CO—CH=CH—$C_6H_5$, —O—CO—CH=$CH_2$, —O—CO—C($CH_3$)=$CH_2$, —O—CO—CBr=$CH_2$, —O—CO—CH=CH—$C_6H_5$, —CH=$CH_2$, —CH=CH—$C_6H_5$ or —C($CH_3$)=$CH_2$.

Especially preferred dyes are those of formulae:

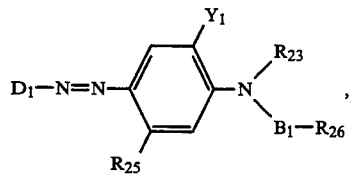
(21)

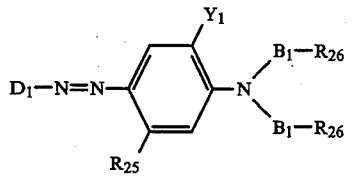
(22)

or

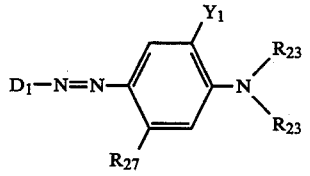
(23)

wherein $R_{23}$ is $C_1$-$C_6$alkyl, $C_3$-$C_6$alkenyl or phenyl;
$R_{25}$ is hydrogen, methyl, methoxy, chloro, bromo, —NH—CO—CH=$CH_2$, —NH—CO—C($CH_3$)=$CH_2$, —NH—CO—CBr=$CH_2$, —NH—CO—CH=CH—$C_6H_5$, —O—CO—CH=$CH_2$, —O—CO—C($CH_3$)=$CH_2$, —O—CO—CBr=$CH_2$, or —O—CO—CH=CH—$C_6H_5$; $R_{26}$ is —NH—CO—CH=$CH_2$, —NH—CO—C($CH_3$)=$CH_2$, —NH—CO—CBr=$CH_2$, —NH—CO—CH=CH—$C_6H_5$, —O—CO—CH=$CH_2$, —O—CO—C($CH_3$)=$CH_2$, —O—CO—CBr=$CH_2$ or —O—CO—CH=CH—$C_6H_5$; and
$R_{27}$ is —NH—CO—CH=$CH_2$, —NH—CO—C($CH_3$)=$CH_2$, —NH—CO—CBr=$CH_2$ or —NH—CO—CH=CH—$C_6H_5$, and wherein $B_1$, $D_1$ and $Y_1$ are as defined for formula (20).

Representative examples of the above dyes are dyes of formulae:

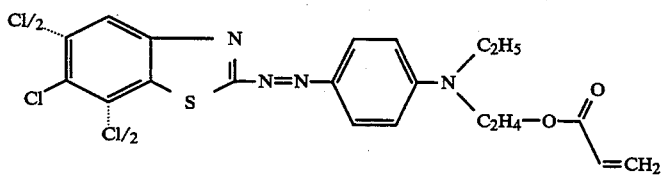
(40)

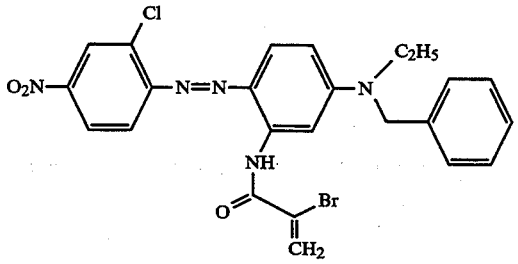
(41)

-continued (42)

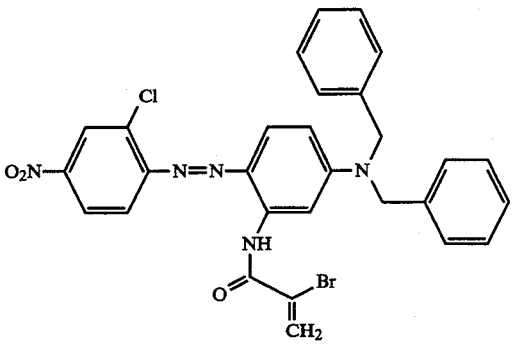

(43)

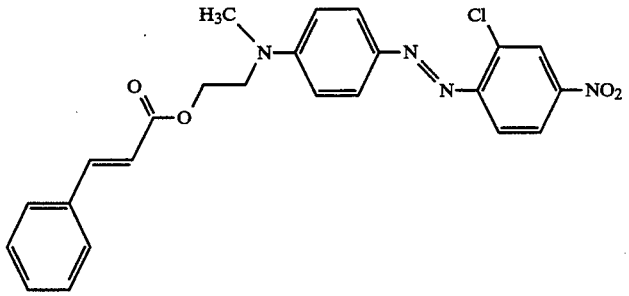

(44)

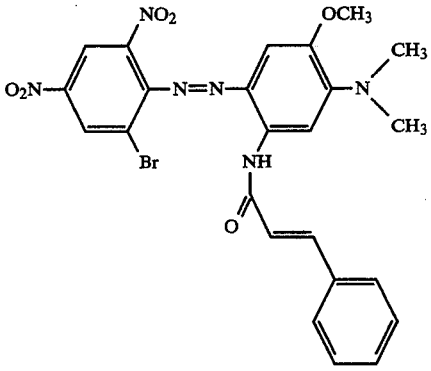

Further preferred dyes are substantially water-insoluble or water insoluble dyes of the anthraquinone series, for example (45)

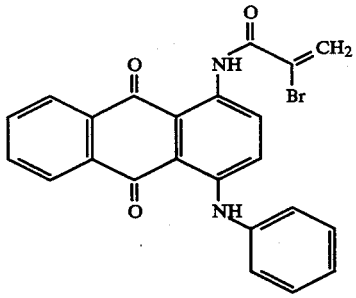

The above dyes are known or they can be prepared by known methods, typically by reacting a solution of the compound to be acylated in anhydrous acetone with about one molar equivalent of an acryloyl chloride. Then about one molar equivalent of pyridine is added at room temperature and the product is precipitated by addition of water.

The binders to be added are polymerisable colourless or substantially colourless (i.e. slightly yellowish) monomers, oligomers or polymers or mixtures thereof, typically N—$C_{1-4}$alkylolacrylamide, N-butoxymethylacrylamide, N-isobutoxymethylacrylamide, N—$C_{1-4}$alkylolmethacrylamide, N-butoxymethylmethacrylamide, N-isobutoxymethylmethacrylamide, N,N,di($C_{1-4}$alkolol)acrylamide, N,N,-di(butoxymethyl)acrylamide, N,N,-di(isobutoxymethyl)acrylamide, N,N,-di($C_{1-4}$methylol)methacrylamide, N,N,-di(butoxymethyl)methacrylamide, N,N,-di(isobutoxymethyl)methacrylamide.

The colourless compounds preferably used in the inventive process are organic monomers, oligomers or polymers or mixtures thereof.

The colourless compounds most preferably used in the novel process are acrylates, diacrylates, acrylic acid or acrylamides.

It is particularly preferred to use mixtures of colourless organic monomers and oligomers in the process of this invention.

The colourless organic compounds which contain at least one polymerisable double bond are devoid of chromophoric radicals. They are organic monomers, oligomers or polymers, or a mixture thereof, which can be polymerised or crosslinked.

A suitable colourless monomer is one having a molecular weight of up to about 1000 and containing at least one polymerisable group.

Bi-, tri-and polyfunctional monomers are also suitable.

The colourless monomer can be used direct not only by itself but also in admixture with other monomers, oliogomers and/or polymers.

A suitable colourless oligomer is one having a molecular weight in the range from 1000 to 10 000 and containing one or more polymerisable groups. If in liquid form, the colourless oligomer can be used by itself direct or as a solution in water or organic solvents or in admixture with other monomers, oligomers and/or polymers.

A suitable colourless polymer is one having a molecular weight of >10 000 and containing one or more polymerisable groups.

If in liquid form, the colourless polymer can be used by itself direct or as a solution in water or organic solvents or in admixture with other monomers, oligomers and/or polymers.

Suitable colourless compounds are ethylenically unsaturated monomers, oligomers and polymers.

Particularly suitable colourless compounds include esters of ethylenically unsaturated carboxylic acids and polyols or polyepoxides, and polymers containing ethylenically unsaturated groups in the chain or in side groups, typically unsaturated polyesters, polyamides and polyurethanes and copolymers thereof, polybutadiene and butadiene copolymers, polyisoprene and isoprene copolymers, polymers and copolymers containing (meth)acryloyl groups in side chains as well as mixtures of one or more such polymers.

Examples of unsaturated carboxylic acids are acrylic acid, methacrylic acid, crotonic acid, itaconic acid, cinnamic acid, and unsaturated fatty acids such as linolenic acid or oleic acid. Acrylic acid and methacrylic acid are preferred.

Suitable polyols are aliphatic and cycloaliphatic polyols. Polyepoxides are typically those based on polyols and epichlorohydrin. Suitable polyols are also polymers or copolymers which contain the hydroxyl groups in the polymer chain or in side groups, including polyvinyl alcohol and copolymers thereof, or hydroxylalkyl polymethacrylates or copolymers thereof. Further suitable polyols are oligoesters carrying hydroxyl end groups.

Exemplary of aliphatic and cycloaliphatic polyols are alkylene diols containing preferably 2 to 12 carbon atoms, including ethylene glycol, 1,2- or 1,3-propanediol, 1,2-, 1,3- or 1,4-butanediol, pentanediol, hexanediol, octanediol, dodecanediol, diethylene glycol, triethylene glycol, polyethylene glycols having molecular weights of preferably 200 to 1500, 1,3-cyclopentanediol, 1,2-1,3-or 1,4-cyclohexanediol, 1,4-dihydroxymethylcyclohexane, glycerol, tris(β-hydroxyethyl)amine, trimethylolethane, trimethylolpropane, pentaerythritol, dipentaerythritol and sorbitol.

The polyols may be partially or completely esterified with one carboxylic acid or with different unsaturated carboxylic acids. The free hydroxyl groups of partial esters can be modified, for example esterified, or esterified with other carboxylic acids.

Representative examples of esters are:

trimethylolpropane triacrylate, trimethylolethane triacrylate, trimethylolpropane trimethacrylate, trimethylolethane trimethacrylate, tetramethylene glycol dimethacrylate, triethylene glycol dimethacrylate, tetraethylene glycol diacrylate, pentaerythritol diacrylate, pentaerythritol triacrylate, pentaerythritol tetraacrylate, dipentaerythritol diacrylate, dipentaerythritol triacrylate, dipentaerythritol tetraacrylate, dipentaerythritol pentaacrylate, dipentaerythritol hexaacrylate, tripentaerythritol octaacrylate, pentaerythritol dimethacrylate, pentaerythritol trimethacrylate, dipentaerythritol dimethacrylate, dipentaerythritol tetramethacrylate, tripentaerythritol octamethacrylate, pentaerythritol diitaconate, dipentaerythritol trisitaconate, dipentaerythritol pentaitaconate, dipentaerythritol hexaitaconate, ethylene glycol dimethacrylate, 1,3-butanediol diacrylate, 1,3-butanediol dimethacrylate, 1,4-butanediol diitaconate, sorbitol triacrylate, sorbitol tetraacrylate, pentaerythritol-modified triacrylate, sorbitol tetramethacrylat, sorbitol pentaacrylate, sorbitol hexaacrylate, oligoester acrylates and methacrylates, glycerol di- and triacrylate, 1,4-cyclohexane diacrylate, bisacrylates and bismethacrylates of polyethylene glycol having a molecular weight of 200–1500, or mixtures thereof.

Suitable colourless compounds are also the amides of identical or different unsaturated carboxylic acids of aromatic, cycloaliphatic and aliphatic polyamides containing preferably 2 to 6, more particularly 2 to 4, amino groups. Exemplary of such polyamines are ethylenediamine, 1,2-or 1,3-propylenediamine, 1,2-, 1,3-or 1,4-butylenediamine, 1,5-pentylenediamine, 1,6-hexylenediamine, octylenediamine, dodecylenediamine, 1,4-diaminocyclohexane, isophoronediamine, phenylenediamine, bisphenylenediamine, bis(β-aminoethyl) ether, diethylenetriamine, triethylenetetramine, bis(β-aminoethoxy)ethane or bis(β-aminopropoxy)ethane. Further suitable polyamines are polymers and copolymers containing amino groups in the side chain and oligoamides carrying amino end groups.

Such unsaturated amides include: methylenebisacrylamide, 1,6-hexamethylenebisacrylamide, diethylenetriaminetris(methacrylamide), bis(methacrylamidopropoxy)ethane, β-methacrylamidoethylmethacrylate, N[(β-hydroxyethoxy)ethyl]acrylamide.

Suitable unsaturated polyesters and polyamides may be derived from maleic acid and diols or diamines. The maleic acid may be partially replaced by other dicarboxylic acids. They can be used together with ethylenically unsaturated comonomers, conveniently styrene. The polyesters and polyamides may also be derived from dicarboxylic acids and ethylenically unsaturated diols or diamines, especially from those having long chains of typically 6 to 20 carbon atoms. Polyurethanes are typically those which are derived from saturated or unsaturated diisocyanates and unsaturated or saturated diols.

Polybutadiene and polyisoprene and copolymers thereof are known. Suitable comonomers are typically olefins including ethylene, propene, butene, hexene, (meth)acrylates, acrylonitrile, styrene or vinyl chloride. Polymers containing (meth)acrylate groups in the side chain are also known. They may be reaction products of epoxy resins derived from novolaks with (meth)acrylic acid, homopolymers or copolymers of polyvinyl alcohol or the hydroxyalkyl derivatives thereof which are esterified with (meth)acrylic acid, or homopolymers and copolymers of (meth)acrylates which are esterified with hydroxyalkyl (meth)acrylates.

The colourless compounds may be used singly or in any mixtures with one another.

Suitable colourless oligomers or polymers are preferably different polyester acrylates, typically $CH_2{=}CH{-}[CO{-}O(CH_2)_n]{-}CO{-}O{-}CH{=}CH_2$, epoxy acrylates, typically $(CH_2{=}CH{-}CO{-}O{-}CH_2{-}CHOH{-}CH_2{-}O{-}C_6H_6)_2C(CH_3)_2$, urethane acrylates, typically

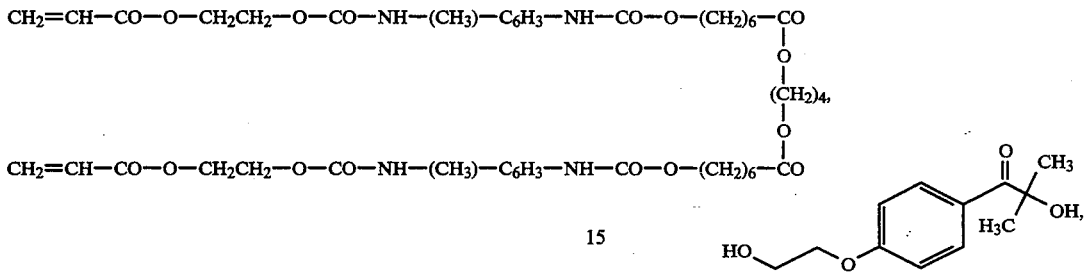

polyether acrylates, typical $$CH_2{=}CH{-}CO{-}O{-}[CH_2{-}\underset{\underset{CH_3}{|}}{CH}{-}O]_n{-}CO{-}O{-}CH{=}CH_2,$$

and silicone acrylates, as known from Textilpraxis International (1987), pages 848–852.

A preferred embodiment of the inventive process comprises using as colourless compounds those containing the acryloyl radical as polymerisable group, oligomeric polyether, polyurethane and polyester acrylates being especially preferred.

In the process of this invention it is preferred to use a colourless monomer selected from the group consisting of N-vinylpyrrolidine, acrylic acid, butyl acrylate, 2-ethylhexyl acrylate, 2-hydroxyethyl acrylate, hydroxypropyl acrylate, butanediol monoacrylate, 2-ethoxyethyl acrylate,-ethylene glycol acrylate, polyethylene glycol bisacrylates having a molecular weight of 200 to 1500, butanediol acrylate, tetraethylene glycol diacrylate, 1,6-hexanediol diacrylate, diethylene glycol diacrylate, dipropylene glycol diacrylate, triethylene glycol diacrylate, tripropylene glycol diacrylate, trimethylolpropane triacrylate, pentaerythritol triacrylate, bromacrylamide, methylenebisdi(bromacrylamide), methylenebisdiacrylamide, N-alkoxyacrylamide, tetraethylene glycol diacrylate, soybean oil acrylate, polybutadiene acrylate, diethylene glycol dimethacrylate, 1,6-hexanediol dimethacrylate, 2-(2-ethoxyethoxy)ethyl acrylate, stearyl acrylate, tetrahydrofurfuryl acrylate, pentaerythritol tetraacrylate, lauryl acrylate, 2-phenoxyethyl acrylate, ethoxylated bisphenol diacrylate, bis(-trimethylolpropane) tetraacrylate, tris(2-hydroxyethyl-)isocyanurate triacrylate, isodecyl acrylate, dipentaerythritol pentaacrylate, ethoxylated trimethylolpropane triacrylate, isobornyl acrylate, ethoxylated tetrabromobisphenol diacrylate, propoxylated neopentyl glycol diacrylate, propoxylated glyceryl triacrylate.

The presence of a photosensitiser is necessary when using ultraviolet radiation. The photosensitiser absorbs the radiation in order to produce free radicals that initiate the polymerisation. Exemplary of photosensitisers or photoinitiators suitable for use in the practice of this invention are carbonyl compounds such as 2,3-hexanedione, diacetyl acetophenone, benzoin and benzoin ethers such as dimethyl, ethyl and butyl derivatives, typically 2,2-diethoxyacetophenone and 2,2-dimethoxyacetophenone, benzophenone or a benzophenone salt, and phenyl-(1-hydroxycyclohexyl)ketone or a ketone of formula benzophenone in conjunction with a catalyst such as triethylamine, N,N'-dibenzylamine and dimethylaminoethanol and benzophenone plus Michler's ketone; nitrogen-containing compounds such as diazomethane, azobisisobutyronitrile, hydrazine, phenylhydrazine as well as trimethylbenzylammonium chloride; and sulfur-containing compounds such as benzene sulfonate, diphenyl disulfide and tetramethylthiuram disulfide. Such photosensitisers are used singly or in conjunction with one another.

The amount of photosensitiser in the applied dye components directly before irradiation is 0.01–20%, preferably 0.1–5%.

Water-soluble as well as water-insoluble photosensitisers are suitable. Furthermore, the copolymerisable photoinitiators mentioned, inter alia, in "Polymers Paint Colour Journal, 180, S 42f (1990)" are especially useful.

In addition to containing dye and photopolymerisable binder, the print pastes and dye liquors may contain the customary auxiliaries such as thickeners, colorants, fillers, dispersants, gildants, antioxidants and polymerisation inhibitors. These last mentioned compounds are usually also added as stabilisers to the photopolymerisable binders.

Furthermore, it is also possible to add, besides the photosensitiser, polymerisation co-initiators such as peroxides or aliphatic azo compounds which are activated by the heat of irradiation and initiate the polymerisation.

The customary catalysts which from free radicals can be used for the polymerisation or copoylmerisation. Typical catalysts are hydrazine derivatives such as hydrazine hydrochloride, organometallic compounds such as tetraethyl lead, and, in particular, aliphatic azo compounds such as $\alpha,\alpha'$-azoisobutyrodinitrile and organic peroxides, chloroacetyl peroxide, trichloroacetyl peroxide, benzoyl peroxide, chlorobenzoyl peroxide, benzoyl acetylperoxide, propionyl peroxide, fluorochloropropionyl peroxide, lauryl peroxide, cumene hydroperoxide, cyclohexanone hydroperoxide, tert-butyl hydroperoxide, di-tert-butyl peroxide, di-tert-amyl peroxide and p-methane hydroperoxide, and inorganic peroxide compounds such as sodium peroxide, alkali percarbonates, alkali persulfates or alkali perborates and, preferably, hydrogen peroxide, which can with advantage replace expensive benzoyl peroxide. The amount of catalyst to be added will depend in known manner on the desired reaction course or on the desired properties of the polymer. It is advantageous to use about 0.05 to 10 % by weight, based on the total amount of binder or binder mixture.

To prevent oxygen inhibition, it can also be advantageous to add anti-blocking agents, typically amines, preferably acrylamines.

The UV light used is suitably radiation whose emission is in the range from 200 to 450 nm, preferably from 210 to 350 nm. The radiation is preferably produced artificially with mercury vapour, xenon or tungsten lamps, fluorescent tubes or carbon arc lamps.

Mercury high-pressure lamps are especially advantageous. However, capillary mercury high-pressure lamps, mercury low-pressure lamps or mercury medium-pressure lamps are also suitable. These last-mentioned lamps can also be pulse-operated to concentrate the radiation in peaks. Pulsed operation is also possible when using xenon lamps if a higher proportion of long-wave light is required.

The precise radiation time of the dyeings or prints will depend on the intensity of the UV source, the distance from the light source, the type and amount of photosensitiser and the permeability of the formulation and the textile substrate to UV light.

Normal radiation times are from 2 seconds to 2 minutes, preferably from 5 seconds to 2 minutes. The fixation can be terminated by discontinuing the irradiation so that it can also be carried out batchwise.

Irradiation may be carried out in an inert gas atmosphere to prevent oxygen inhibition; but this precautionary measure is not essential. Oxygen inhibition can also be effectively prevented by the addition of anti-blocking agents, i.e. amines and also, more particularly, aminoacrylates.

The novel process is applicable to a very wide range of organic materials, including fibres of animal origin such as wool, silk, hairs (e.g. as felt) or regenerated fibres such as protein fibres or alginate fibres, man-made fibres, including polyvinyl, polyacrylonitrile, polyester, polyamide or polyurethane fibres, polypropylene and, more particularly, cellulosic materials such as bast fibres, including linen, hemp, jute, ramie and, preferably, cotton, as well as cellulosic fibres such as viscose or modal fibres, copper, nitrate or saponified acetate fibres, or cellulose acetate fibres, for example secondary acetate fibres, or cellulose triacetate fibres, typically Arnel®, Trilan®, Courpleta® or Tricel®.

The above fibres may be in any of the forms of presentation used especially in the textile industry, typically filaments, yarns, woven fabrics, knitted fabrics or nonwovens such as felts.

Preferred fibre material in the process of this invention is wool, silk, hairs, alginate fibres, polyvinyl, polyacrylonitrile, polyester, polyamide, polypropylene or polyurethane fibres or cellulosic fibres.

Especially preferred fibre materials are cellulose fibres and also polyester/cellulose blends.

The treatment of the material to be dyed with a dye as defined herein can be effected in conventional manner, if the material is a textile fabric, by impregnating the material with a dye solution in an exhaust bath or by spraying or padding with a pad solution, or by printing on a knife-coater or by the ink-jet printing method.

Normally the colourless binder, the photosensitiser and the other auxiliaries are applied, together with the dye, to the material. It is, however, also possible to apply the colourless binder and/or the photosensitiser as well as the optional polymerisation co-initiators separately, conveniently in the form of a pre- or aftertreatment. Thus in the case of dyeings obtained by the exhaust process or by padding it is especially useful to impregnate the woven or knitted fabric first with the photosensitiser and then to dye the fabric with the dye liquor which also contains photosensitiser.

Also useful are emulsion printing methods in which the mixture of the photopolymerisable binders replaces the hydrophobic component so that neither white spirit nor thickener is necessary.

The process is particularly suitable for carrying out continuous dyeing and fixing processes. However, the process, or partial steps thereof, can also be carried out batchwise.

The invention further relates to formulations comprising a dye which contains at least one polymerisable double bond or at least one polymerisable ring system, at least one colourless binder which contains at least one polymerisable double bond, and at least one photosensitiser. Preferred formulations comprise those preferred individual components as exemplified in the description of the dyes, colourless binders and photosensitisers. These formulations may comprise the further auxiliaries customarily used for dyeing and printing. These formulations will be particularly understood as meaning print pastes, preferably those suitable for emulsion printing.

In the use Examples, the irradiation is carried out with two 50 watt mercury high-pressure lamps at a transport speed of 10–20 m/min. The samples are irradiated on both sides and with high doses in a number of passes. After irradiation, the dyeings and prints are given the conventional washing off for reactive dyes.

The fixation percentages are determined colorimetrically from the relative tinctorial strength. To determine the fixation percentage, the dyed or printed, dried but non-irradiated and unwashed sample is used as reference with a tinctorial strength of 100 %. For comparison, the relative tinctorial strength is determined of the second sample which has been irradiated and then washed off cold and hot and dried.

EXAMPLE 1

A cotton satin fabric is printed with a print paste which contains 30 g/kg of the dye of formula

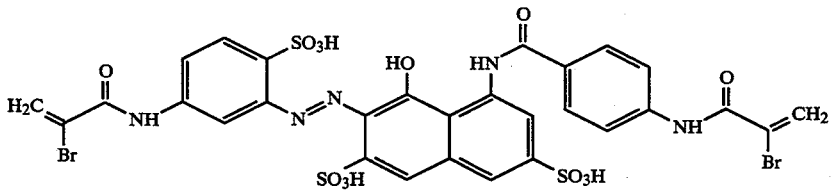

50 g/kg of an oligoethylene glycol diacrylate having a relative molecular mass of 508, 50 g/kg of trimethylolpropane triacrylate, 100 g/l of urea, 30 g/kg of sodium alginate and, as photoinitiator, a mixture of 2.5 g/kg of benzophenone and 2.5 g/kg of phenyl-(1-hydroxycyclohexyl)ketone. The print is dried and then irradiated under a mercury high-pressure lamp with UV light with an energy of 436 J/cm$^2$ on each side of the fabric. The dye fixation is 60%. A brilliant red dyeing with superior fastness properties is obtained.

EXAMPLE 2

A cotton satin fabric is printed with a print paste which contains 30 g/kg of the dye of formula

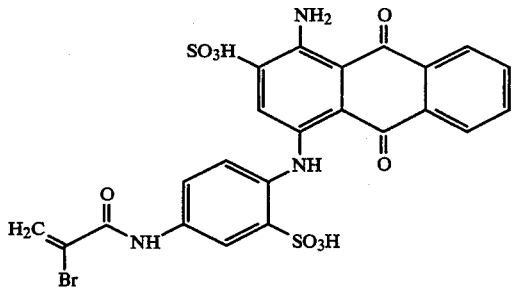

95 g/kg of an oligoethylene glycol diacrylate having a relative molecular mass of 508, 5 g/kg of trimethylolpropane triacrylate, 100 g/l of urea, 30 g/kg of sodium alginate and, as photoinitiator, a mixture of 2.5 g/kg of benzophenone and 2.5 g/kg of phenyl-(1-hydroxycyclohexyl)ketone. The print is dried and then irradiated under a mercury high-pressure lamp with UV light with an energy of 436 J/cm$^2$ on each side of the fabric. The dye fixation is 77%. A blue dyeing with superior fastness properties is obtained.

EXAMPLE 3

A cotton satin fabric is printed with a print paste which contains 30 g/kg of the dye described in Example 1,100 g/kg of an oligoethylene glycol diacrylate having a relative molecular mass of 508, 100 g/l of urea, 30 g/kg of sodium alginate and, as photoinitiator, a mixture of 2.5 g/kg of benzophenone and 2.5 g/kg of phenyl-(1-hydroxycyclohexyl)ketone. The print is dried and then irradiated under a mercury high-pressure lamp with UV light with an energy of 436 J/cm$^2$ on each side of the fabric. The dye fixation is 50%. A red dyeing with superior fastness properties is obtained.

EXAMPLE 4

A cotton satin fabric is printed with a print paste which contains 30 g/kg of the dye described in Example 1, 200 g/kg of a 50% aqueous solution of N-methylolacrylamide, 100 g/l of urea, 30 g/kg of sodium alginate and, as photoinitiator, a mixture of 2.5 g/kg of benzophenone and 2.5 g/kg of phenyl-( 1-hydroxycyclohexyl)ketone. The print is dried and then irradiated under a mercury high-pressure lamp with UV light with an energy of 436 J/cm$^2$ on each side of the fabric. The dye fixation is 64%. A red dyeing with superior fastness properties is obtained.

EXAMPLE 5

A cotton satin fabric is printed with a print paste which contains 30 g/kg of the dye described in Example 1, 50 g/kg of an oligoethylene glycol diacrylate having a relative molecular mass of 508, 50 g/kg of a polyether triacrylate, 100 g/l of urea, 30 g/kg of sodium alginate and, as photoinitiator, a mixture of 2.5 g/kg of benzophenone and 2.5 g/kg of phenyl-(1-hydroxycyclohexyl)ketone. The print is dried and then irradiated under a mercury high-pressure lamp with UV light with an energy of 436 J/cm$^2$ on each side of the fabric. The dye fixation is 52%. A red dyeing with superior fastness properties is obtained.

EXAMPLE 6

A cotton satin fabric is printed with a print paste which contains 30 g/kg of the dye described in Example 1, 50 g/kg of an oligoethylene glycol diacrylate having a relative molecular mass of 508, 50 g/kg of methylenebisacrylamide, 100 g/l of urea, 30 g/kg of sodium alginate and, as photoinitiator, a mixture of 2.5 g/kg of benzophenone and 2.5 g/kg of phenyl-(1-hydroxycyclohexyl)ketone. The print is dried and then irradiated under a mercury high-pressure lamp with UV light with an energy of 436 J/cm$^2$ on each side of the fabric. The dye fixation is 67%. A red dyeing with superior fastness properties is obtained.

EXAMPLE 7

A cotton satin fabric is printed with a print paste which contains 30 g/kg of the dye of formula

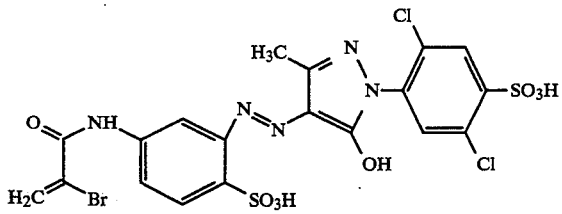

95 g/kg of an oligoethylene glycol diacrylate having a relative molecular mass of 508, 5 g/kg of trimethylolpropane triacrylate, 100 g/l of urea, 30 g/kg of sodium alginate and, as photoinitiator, a mixture of 2.5 g/kg of benzophenone and 2.5 g/kg of phenyl-(1-hydroxycyclohexyl)ketone. The print is dried and then irradiated under a mercury high-pressure lamp with UV light with an energy of 436 J/cm$^2$ on each side of the fabric. The dye fixation is 59%. A yellow dyeing with superior fastness properties is obtained.

EXAMPLE 8

A cotton satin fabric is printed with a print paste which contains 30 g/kg of the dye of formula

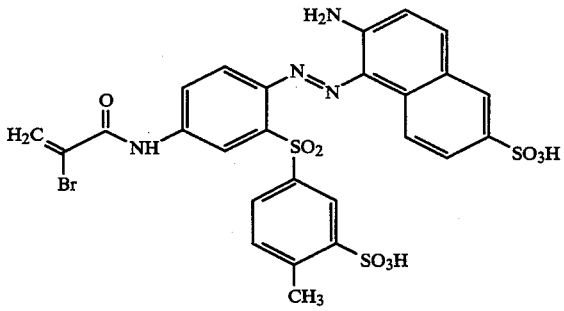

95 g/kg of an oligoethylene glycol diacrylate having a relative molecular mass of 508, 5 g/kg of trimethylolpropane triacrylate, 100 g/l of urea, 30 g/kg of sodium alginate and, as photoinitiator, a mixture of 2.5 g/kg of benzophenone and 2.5 g/kg or phenyl-(1-hydroxycyclohexyl)ketone. The print is dried and then irradiated under a mercury high-pressure lamp with UV light with an energy of 436 J/cm$^2$ on each side of the fabric. The dye fixation is 57%. A red dyeing with superior fastness properties is obtained.

EXAMPLE 9

A cotton satin fabric is printed with a print paste which contains 30 g/kg of the dye of formula

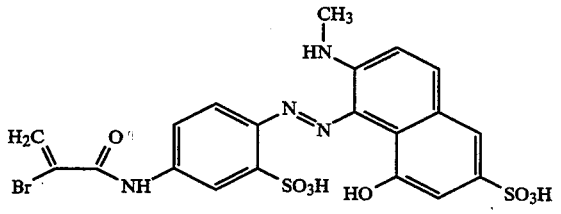

95 g/kg of an oligoethylene glycol diacrylate having a relative molecular mass of 508, 5 g/kg of trimethylolpropane triacrylate, 100 g/l of urea, 30 g/kg of sodium alginate and, as photoinitiator, a mixture of 2.5 g/kg of 4-(trimethylammoniumethyl)benzophenone chloride and 2.5 g/kg of the ketone of formula

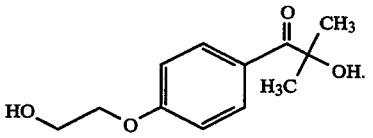

The print is dried and then irradiated under a mercury high-pressure lamp with UV light with an energy of 436 J/cm². The dye fixation is 74%. A red dyeing with superior fastness properties is obtained.

EXAMPLE 10

A cotton satin fabric is padded to a pick-up of 67% with a solution which contains 30 g/kg of the dye described in Example 9, 50 g/kg of an oligoethylene glycol diacrylate having a relative molecular mass of 508, 100 g/l of urea and, as photoinitiator, 5.0 g/kg of the n-fixture described in Example 9. The dyeing is dried and then irradiated under a mercury high-pressure lamp with UV light with an energy of 872 J/cm². A red dyeing with superior fastness properties is obtained.

EXAMPLE 11

A cotton satin fabric is impregnated with a 1:1 mixture of benzophenone and phenyl-(1-hydroxycyclohexyl)keton (add-on c. 0.75%) and then padded to a pick-up of 66% with 30 g/l of the dye described in Example 9, 50 g/l of an oligoethylene glycol diacrylate having a relative molecular mass of 508, 50 g/l of urea and, as photoinitiator, 2.5 g/l of benzophenone and 2.5 g/l of phenyl-(1-hydroxycyclohexyl)ketone. The dyeing is dried and then irradiated under a mercury high-pressure lamp with UV light with an energy of 109 J/cm². A red dyeing with superior fastness properties is obtained.

EXAMPLE 12

An aqueous solution of 10 g/l of the dye described in Example 1 and 41 g/kg of an oligoethylene glycol diacrylate having a relative molecular mass of 508, with 1.8 g/l of benzophenone and 1.8 g/l of phenyl-(1-hydroxycyclohexyl)ketone as photoinitiator, is sprayed on to a cotton satin fabric (add-on 33%). The fabric is dried and then irradiated under a mercury high-pressure lamp with UV light with an energy of 218 J/cm². A red dyeing with superior fastness properties is obtained.

EXAMPLE 13

An emulsion is prepared from 1 part of water and 4 parts of white spirit, with the addition of an emulsifier conventionally used for emulsion printing. Into this emulsion are then stirred 3% of the dye described in Example 1, 12% of an oligoethylene glycol diacrylate having a relative molecular mass of 508, and, as photoinitiator, 0.25% of benzophenone and 0.25% of phenyl-(1-hydroxycyclohexyl)ketone. A cotton satin fabric is printed with this emulsion (add-on 66%). The fabric is dried and then irradiated under a mercury high-pressure lamp with UV light with an energy of 436 J/cm². A red dyeing with superior fastness properties is obtained.

EXAMPLE 14

An emulsion is prepared from 1 part of water and 5 parts of an alkoxylated polyether tetraacrylate, with the addition of an emulsifier conventionally used for emulsion printing. Into this emulsion are stirred 0.5% of the dye of formula

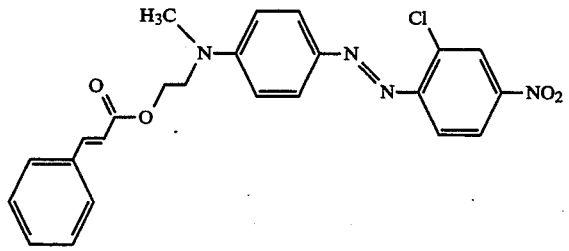

and, as photoinitiator, 0.25% of benzophenone and 0.25% of phenyl-(1-hydroxycyclohexyl)ketone. A cotton satin fabric is printed with this emulsion (add-on 66%). The fabric is dried and then irradiated under a mercury high-pressure lamp with UV light with an energy of 436 J/cm². The dye fixation is determined by removing the dye with ethanol from an irradiated, unwashed sample and a non-irradiated sample. The samples are treated once at 40° C. and subsequently for 30 minutes at boiling temperature. Both extracts are combined and the percentage fixation is determined via the extinction (at $\lambda_{max}$). The dye fixation is 83%. A red dyeing with superior fastness properties is obtained.

What is claimed is:

1. A process for fixing dyes on fibre material, which comprises fixing a dye containing at least one polymerisable double bond or at least one polymerisable ring system, in the presence of at least one colorless binder which contains at least one polymerisable double bond, said colorless binder being selected from the group consisting of N-vinylpyrrolidine, acrylic acid, butyl acrylate, 2-ethylhexyl acrylate, 2-hydroxyethyl acrylate, hydroxypropyl acrylate, butanediol monoacrylate, 2-ethoxyethyl acrylate, ethylene glycol acrylate, polyethylene glycol bisacrylates having a molecular weight of 200 to 1500, butanediol acrylate, tetraethylene glycol diacrylate, 1,6-hexanediol diacrylate, diethylene glycol diacrylate, dipropylene glycol diacrylate, triethylene glycol diacrylate, tripropylene glycol diacrylate, trimethylolpropane triacrylate, pentaerythritol triacrylate, bromacrylamide, methylenebisdi(bromacrylamide), methylenebisdiacrylamide, N-alkoxyacrylamide, tetraethylene glycol diacrylate, soybean oil acrylate, polybutadiene acrylate, diethylene glycol dimethacrylate, 1,6-hexanediol dimethacrylate, 2-(2-ethoxyethoxy)ethyl acrylate, stearyl acrylate, tetrahydrofurfuryl acrylate, pentaerythritol tetraacrylate, lauryl acrylate, 2-phenoxyethyl acrylate, ethoxylated bisphenol diacrylate, bis(trimethylolpropane) tetraacrylate, tris(2-hydroxyethyl)isocyanurate triacrylate, isodecyl acrylate, dipentaerythritol pentaacrylate, ethoxylated trimethylolpropane triacrylate, isobornyl acrylate, ethoxylated tetrabromobisphenol diacrylate, propoxylated neopentyl glycol diacrylate, propoxylated glyceryl triacrylate, and at least one photosensitiser, by subjecting said material to free radical polymerization by irradiation with UV light.

2. A process according to claim 1, which comprises fixing a dye of formula $$D-(X)_m \quad (1),$$

wherein D is the radical of an organic dye of the monoazo or polyazo series, of the metal complex azo, anthraquinone, phthalocyanine, formazan, azomethine, nitroaryl, dioxazine, phenazine, stilbene, triphenylmethane, xanthene, thioxanthone, naphthoquinone, pyrenequinone or perylenetetracarbimide series, X is a radical containing a polymerisable double bond or a polymerisable ring system, and m is 1, 2, 3, 4, 5 or 6.

3. A process according to claim 1, wherein the dye contains an acryloyl, α-bromactyloyl, α-chloracryloyl, vinylsulfonyl, vinyl or epoxidyl radical as polymerisable double bond.

4. A process according to claim 3, wherein comprises the use of a dye which contains an acryloyl, α-bromacryloyl or vinylsulfonyl radical as polymerisable double bond.

5. A process according to claim 5, wherein the colorless binder is selected from the group consisting of acrylates, diacrylates, acrylic acid and acrylamides.

6. A process according to claim 1, wherein the colorless binder is a mixture of monomeric and oligomeric colorless binders.

7. A process according to claim 6, wherein the colorless oligomer is a polyether, polyurethane or polyester acrylate oligomer.

8. A process according to claim 1, wherein the photosensitiser is selected from the group consisting of 2,3-hexanedione, diacetyl acetophenone, benzoin, 2,2-diethoxyacetophenone, 2,2-dimethoxyacetophenone, benzophenone, a salt of benzophenone, phenyl-(1-hydroxycyclohexyl)ketone, and a ketone of formula

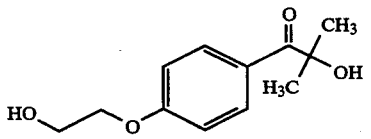

9. A process according to claim 1, wherein the polymerisable double bond or polymerisable ring system is an α-bromoacryloyl or cinnamoyl radical, the binder is an oligoethylene glycol diacrylate, N-methylolacrylamide, trimethylolpropane triacrylate, polyether triacrylate, methylenebisacrylamide or an alkoxylated polyether tetraacrylate and the photosensitiser is a mixture of benzophenone or a salt of benzophenone and phenyl-( 1-hydroxycyclohexyl)ketone or a ketone of formula

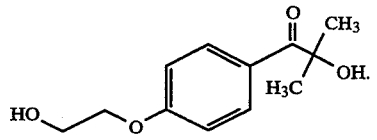

10. A process according to claim 1, wherein the fibre material is selected from the group consisting of wool, silk, hairs, alginate fibres, polyvinyl, polyacrylonitrile, polyester, polyamide, polypropylene, polyurethane fibres and cellulosic fibres.

11. A process of claim 1 wherein the photosensitizer is a combination of benzophenone and a catalyst.

12. A process of claim 11 wherein the catalyst is selected from the group consisting of triethylamine, N,N'-dibenzylamine dimethylaminoethanol, Michler's ketone, diazomethane, azobisisobutyronitrile, hydrazine, phenylhydrazine, trimethylbenzylammonium chloride, benzene sulfonate, diphenyl disulfide and tetramethylthiuram disulfide.

13. A process of claim 1 wherein the dye, the binder and the photosensitizer are applied by impregnation with a dye solution from an exhaust bath, spraying, padding, printing on a knife-coater or ink-jet printing.

14. A process of claim 1 wherein the photosensitizer is applied to the fibre material before the dye.

15. The dyed or printed fibre material fixed by the process as claimed in claim 1.

16. A formulation for dyeing which comprises a dye which contains at least one polymerisable double bond or at least one polymerisable ring system, at least one colourless binder which contains at least one polymerisable double bond, said colorless binder being selected from the group consisting of N-vinylpyrrolidine, acrylic acid, butyl acrylate, 2-ethylhexyl acrylate, 2-hydroxyethyl acrylate, hydroxypropyl acrylate, butanediol monoacrylate, 2-ethoxyethyl acrylate, ethylene glycol acrylate, polyethylene glycol bisacrylates having a molecular weight of 200 to 1500, butanediol acrylate, tetraethylene glycol diacrylate, 1,6-hexanediol diacrylate, diethylene glycol diacrylate, dipropylene glycol diacrylate, triethylene glycol diacrylate, tripropylene glycol diacrylate, trimethylolpropane triacrylate, pentaerythritol triacrylate, bromacrylamide, methylenebisdi(bromacrylamide), methylenebisdiacrylamide, N-alkoxyacrylamide, tetraethylene glycol diacrylate, soybean oil acrylate, polybutadiene acrylate, diethylene glycol dimethacrylate, 1,6-hexanediol dimethacrylate, 2-(2-ethoxyethoxy)ethyl acrylate, stearyl acrylate, tetrahydrofurfuryl acrylate, pentaerythritol tetraacrylate, lauryl acrylate, 2-phenoxyethyl acrylate, ethoxylated bisphenol diacrylate, bis(trimethylolpropane) tetraacrylate, tris(2-hydroxyethyl)isocyanurate triacrylate, isodecyl acrylate, dipentaerythritol pentaacrylate, ethoxylated trimethylolpropane triacrylate, isobornyl acrylate, ethoxylated tetrabromobisphenol diacrylate, propoxylated neopentyl glycol diacrylate, propoxylated glyceryl triacrylate, and at least one uv photosensitiser.

* * * * *